US011052508B2

(12) United States Patent
Sagae et al.

(10) Patent No.: US 11,052,508 B2
(45) Date of Patent: Jul. 6, 2021

(54) CENTERLESS GRINDING APPARATUS AND WORK GRINDING CONDITION MONITORING METHOD

(71) Applicant: MICRON MACHINERY CO., LTD., Yamagata (JP)

(72) Inventors: Mohee Sagae, Yamagata (JP); Satoshi Kobayashi, Yamagata (JP); Katsuyuki Takeda, Yamagata (JP)

(73) Assignee: Micron Machinery Co., Ltd., Yamagata (JP)

( * ) Notice: Subject to any disclaimer, the term of this patent is extended or adjusted under 35 U.S.C. 154(b) by 530 days.

(21) Appl. No.: 16/138,243

(22) Filed: Sep. 21, 2018

(65) Prior Publication Data

US 2019/0091831 A1 Mar. 28, 2019

(30) Foreign Application Priority Data

Sep. 28, 2017 (JP) ..... JP2017-189045

(51) Int. Cl.
*B24B 5/18* (2006.01)
*B24B 5/30* (2006.01)
(Continued)

(52) U.S. Cl.
CPC ..... *B24B 49/16* (2013.01); *B24B 5/18* (2013.01); *B24B 5/30* (2013.01); *B24B 5/307* (2013.01);
(Continued)

(58) Field of Classification Search
CPC .... B24B 5/04; B24B 5/18; B24B 5/22; B24B 5/30; B24B 5/307; B24B 49/02;
(Continued)

(56) References Cited

U.S. PATENT DOCUMENTS 4,926,603 A 5/1990 Frost et al.
5,643,051 A * 7/1997 Zhou ..... B24B 5/22 451/11
(Continued)

FOREIGN PATENT DOCUMENTS

JP S60-500047 A 1/1985
JP H09-323244 A 12/1997
(Continued)

OTHER PUBLICATIONS

Office Action dated Jul. 23, 2019 issued in corresponding Japanese patent application No. 2017-189045.

*Primary Examiner* — Eileen P Morgan
(74) *Attorney, Agent, or Firm* — Carrier Blackman & Associates, P.C.; Joseph P. Carrier; William D. Blackman

(57) ABSTRACT

When a work W rotates counterclockwise about an axis $O_w$ and is subjected to infeed grinding by a regulating wheel (1) which rotates clockwise about an axis $O_1$ and a grinding wheel (2) which rotates clockwise about an axis $O_2$, a load F acting on a blade (4), a load acting on the work W supported by the blade (4), and a load operating position y in the blade (4) at any given time are measured by a controller (20) based on the outputs of a first stress sensor $S_1$ and a second stress sensor $S_2$ and according to the correlation information stored in a storage device. If the component of a specified frequency extracted by performing frequency analysis of the time series of the load exceeds a threshold value, then designation processing is carried out to reduce the component of the designated frequency to the threshold value or less.

9 Claims, 6 Drawing Sheets

(51) Int. Cl.

| | |
|---|---|
| ***B24B 5/307*** | (2006.01) |
| ***B24B 49/02*** | (2006.01) |
| ***B24B 49/16*** | (2006.01) |
| ***B24B 49/18*** | (2006.01) |
| ***B24B 53/04*** | (2012.01) |

(52) U.S. Cl.
CPC ..... *B24B 49/02* (2013.01); *B24B 49/18* (2013.01); *B24B 53/04* (2013.01)

(58) Field of Classification Search
CPC ..... B24B 49/04; B24B 49/10; B24B 49/16; B24B 49/18; B24B 53/04
USPC ..... 451/5, 10, 11, 49, 243, 56, 443
See application file for complete search history.

(56) References Cited

U.S. PATENT DOCUMENTS

| | | | | |
|---|---|---|---|---|
| 5,938,503 | A * | 8/1999 | Cook | B24B 5/04 451/10 |
| 2005/0078893 | A1* | 4/2005 | Furuta | B24B 5/22 384/100 |
| 2008/0248724 | A1* | 10/2008 | Tschudin | B24B 5/18 451/10 |
| 2010/0173571 | A1 | 7/2010 | Kobayashi | |

FOREIGN PATENT DOCUMENTS

| | | | |
|---|---|---|---|
| JP | 2008-149387 | A | 7/2008 |
| JP | 5057947 | B2 | 10/2012 |
| WO | 84/02101 | A1 | 6/1984 |

* cited by examiner

CENTERLESS GRINDING APPARATUS AND WORK GRINDING CONDITION MONITORING METHOD

BACKGROUND OF THE INVENTION

Field of the Invention

The present invention relates to a centerless grinding apparatus.

Description of the Related Art

There have been proposed through-feed centerless grinding apparatuses (refer to, for example, Patent Document 1). When a work (workpiece) is supplied between a grinding wheel and a regulating wheel, which are rotating, the work proceeds in the axial direction of the grinding wheel in a state in which the work is being supported by the regulating wheel and a blade, and the outer surface of the work is ground during this process. In order to control the finished dimensions with high accuracy in the grinding process, it is important to detect the load applied to the work from the grinding wheel and the regulating wheel. Further, the finished shape accuracy, especially the roundness, of the work changes according to the work machining height (hereinafter referred to as "the center height"). Hence, there have been proposed methods for efficiently adjusting the center height (refer to, for example, Patent Document 2).

Patent Document 1: Japanese Patent Application Laid-Open No. 2008-149387

Patent Document 2: Japanese Patent No. 5057947

SUMMARY OF THE INVENTION

However, when measuring the load applied to a work through the intermediary of a regulating wheel, as in the case described in, for example, Patent Document 1, it is possible, to a certain degree, to measure a so-called static load change, which is a slow change in time series. On the other hand, if a dynamic load change, which is quick in time series, such as a chatter vibration peculiar to centerless grinding, is to be measured through the intermediary of a regulating wheel that contains a rubber and has a low modulus of elasticity, then the accuracy deteriorates because of vibration damping. Therefore, even if a ground surface in the cross section or the outer surface of the work comes to have a non-round shape, such as a shape that undulates along the peripheral direction thereof, due to the chatter vibration, it is difficult to properly monitor such a condition due to the change in load, and the accuracy of a shape may not be improved.

Accordingly, an object of the present invention is to provide a centerless grinding apparatus and the like capable of accurately measuring a change in a static load and a change in a dynamic load at the same time by measuring a load applied to the work through the intermediary of a metallic blade thereby to enable proper and prompt adjustments to be made according to the grinding condition of the work.

The present invention relates to a centerless grinding apparatus including: a grinding wheel; a regulating wheel; a blade disposed between the grinding wheel and the regulating wheel; a work rest which supports the blade; a stress sensor disposed on the work rest; a first drive mechanism which drives the regulating wheel in at least a horizontal direction; a second drive mechanism which drives the grinding wheel in at least the horizontal direction; and a controller which controls operation of each of the first drive mechanism and the second drive mechanism, wherein a work is supported by the grinding wheel, the regulating wheel and the blade, and the grinding wheel and the regulating wheel are rotated thereby to grind the work. Further, the present invention relates to a method for monitoring the grinding condition of the work in the centerless grinding apparatus.

In the centerless grinding apparatus in accordance with the present invention, a pair of stress sensors acting as the stress sensor are each disposed at different places in the blade or the work rest in a longitudinal direction of the blade, and the controller includes: a storage device which stores a correlation information indicating a correlation between a load acting on the blade and the output of each of the pair of stress sensors; a load measurement unit which measures a load acting on the blade based on the output of each of the pair of stress sensors and according to the correlation information stored in the storage device; a frequency analyzer which determines whether a component of a designated frequency extracted by performing a frequency analysis of a time series of the load measured by the load measurement unit exceeds a threshold value; and a designation processing unit which carries out designation processing for setting the component of the designated frequency to the threshold value or less in a case where the frequency analyzer determines that the component of the designated frequency exceeds the threshold value.

In the centerless grinding apparatus according to the present invention, preferably, the designation processing unit at least either causes the first drive mechanism to drive the regulating wheel at least in the horizontal direction or the second drive mechanism to drive the grinding wheel at least in the horizontal direction as the designation processing in order to adjust a center height of the work.

Preferably, the centerless grinding apparatus according to the present invention further includes: a third drive mechanism which drives the work rest in at least a vertical direction, wherein the controller is configured to control an operation of the third drive mechanism in addition to the operations of the first drive mechanism and the second drive mechanism, and the designation processing unit causes the third drive mechanism to drive the work rest at least in the vertical direction as the designation processing in order to adjust a center height of the work.

In the centerless grinding apparatus according to the present invention, the designation processing unit preferably carries out the designation processing so as to decrease the center height of the work in a case where a component of a first designated frequency as the designated frequency exceeds a first threshold value as the threshold value in the case where, for example, a finished work section has a shape having an even-number of crest pitches, such as 12 or 14 crests, or to increase the center height of the work in a case where a component of a second designated frequency as the designated frequency exceeds a second threshold value as the threshold value in the case where, for example, a finished work section has a shape having an odd-number of crest pitches, such as 3 or 5 crests.

Further, the deterioration of the accuracy of a finished work shape during a grinding process is frequently attributable to the wear on a grinding wheel or a regulating wheel. Preferably, therefore, a static load change and a dynamic load change in a load applied to a work are monitored, the centerless grinding apparatus according to the present invention includes a dressing device for dressing at least one of the regulating wheel and the grinding wheel, and the designation processing unit carries out dressing of at least one of the regulating wheel and the grinding wheel by the dressing device as the designation processing.

In the centerless grinding apparatus according to the present invention, preferably, the storage device stores the information indicating a correlation among a load acting on the blade, a load operating position in the blade, and the outputs of each of the pair of stress sensors as the correlation information, and the controller measures the load acting on the blade and the load operating position in the blade on the basis of the outputs of the pair of stress sensors and according to the correlation information stored in the storage device.

In the centerless grinding apparatus according to the present invention, preferably, the storage device stores, as the correlation information, expressions $s=g_1(f, y)$ and $s=g_2(f, y)$, which denote a curved surface in a three-dimensional Cartesian coordinate system having a load F acting on the blade, a load operating position y in the blade, and an output s of each of the pair of stress sensors as coordinate axes thereof, and the controller measures the load F acting on the blade and the load operating position y in the blade as the coordinate value of the intersection point of curves $s_1=g_1(f, y)$ and $s_2=g_2(f, y)$ in a plane f-y based on the outputs $s_1$ and $s_2$ of each of the pair of stress sensors and according to the correlation information.

In the centerless grinding apparatus according to the present invention, the pair of stress sensors are preferably disposed symmetrically with reference to the blade.

The work grinding condition monitoring method includes: a load measurement step of measuring a load acting on the blade based on outputs of each of the pair of stress sensors serving as the stress sensors, which are disposed at different places in the blade or the work rest in a longitudinal direction of the blade, and according to the correlation information indicating the correlation between the load acting on the blade and the outputs of each of the pair of stress sensors; a frequency analysis step of determining whether a component of a designated frequency extracted by performing a frequency analysis of a time series of the load measured by the load measurement step exceeds a threshold value; and a designation processing step of carrying out designation processing for setting the component of the designated frequency to the threshold value or less in a case where it is determined in the frequency analysis step that the component of the designated frequency exceeds the threshold value.

According to the centerless grinding apparatus and the work grinding condition monitoring method in accordance with the present invention, it is taken into consideration that the output of a stress sensor changes as the load operating position in a blade changes even if a load remains the same, and the output of another stress sensor disposed at a different location from that of the foregoing stress sensor is used, thereby improving the accuracy of measurement of a load acting on the blade. Thus, if the outer surface of a work has a non-round shape and the grinding condition is improper, then a situation in which a component of a designated frequency to be extracted by the frequency analysis of the time series of the load is not extracted until the component exceeds a threshold or a situation in which an excessively long time is required for the extraction can be prevented. Therefore, the accuracy of monitoring the grinding condition of a work is improved, and designation processing is promptly carried out if the grinding condition of the work is improper, thus enabling proper corrective measures to be taken to improve the condition.

DESCRIPTION OF THE PREFERRED EMBODIMENTS (Configuration)

Figure 1:
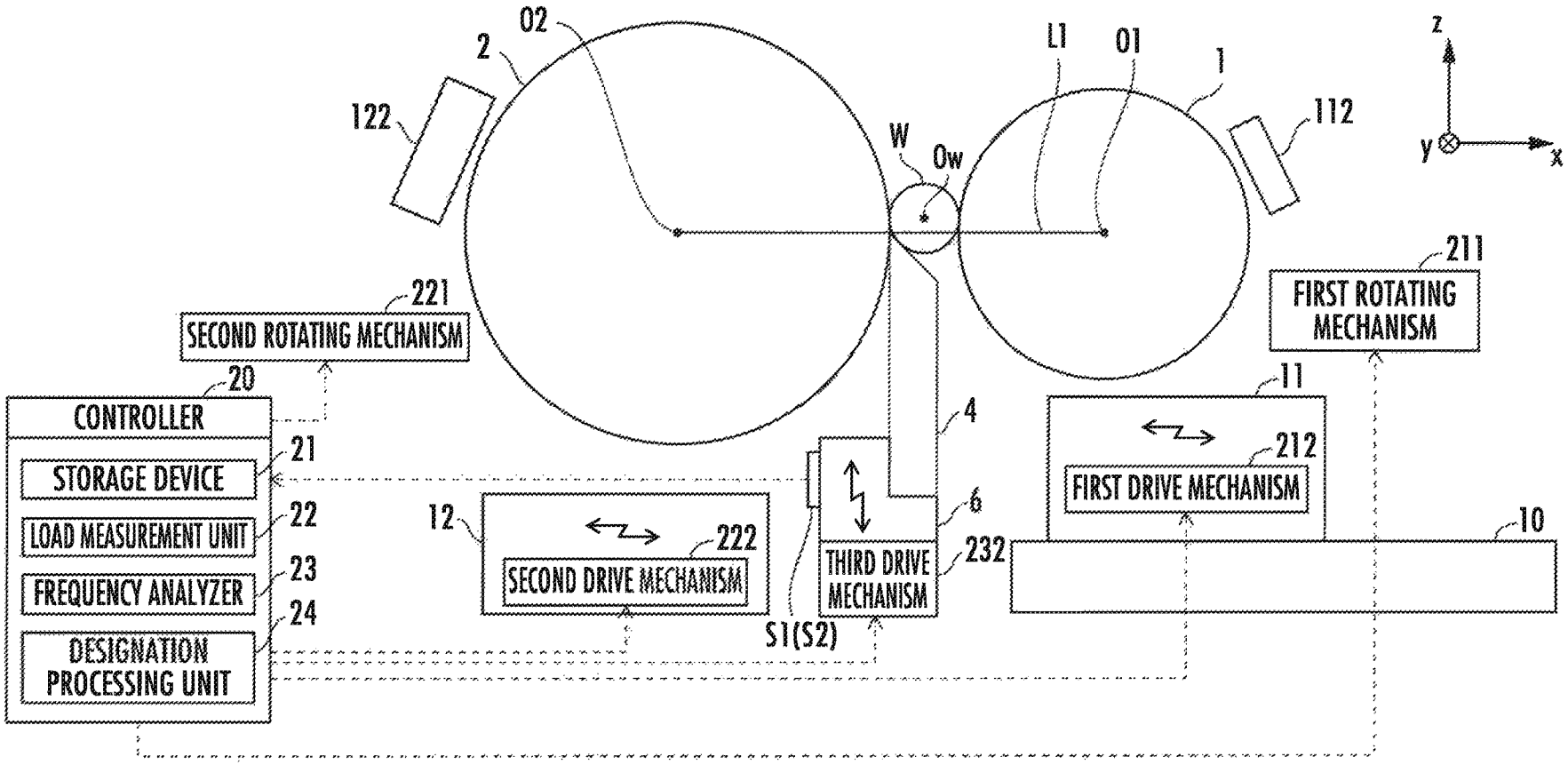
FIG. 1 is a block diagram illustrating a centerless grinding apparatus as an embodiment of the present invention.

The centerless grinding apparatus as an embodiment of the present invention illustrated in FIG. 1 includes a regulating wheel 1, a grinding wheel 2, a blade 4, a controller 20, a first dressing device 112, a second dressing device 122, a first rotating mechanism 211, a first drive mechanism 212, a second rotating mechanism 221, a second drive mechanism 222, and a third drive mechanism 232.

The regulating wheel 1 has a substantially columnar shape and is supported to be rotatable about an axis $O_1$ by the first rotating mechanism 211 composed of an actuator, such as an electric motor. If the centerless grinding apparatus is a through-feed type, then the axis $O_1$ extends at an angle with respect to an axis $O_2$ of the grinding wheel 2, and the regulating wheel 1 is formed to have a substantially one-sheet hyperboloid shape (a substantially cylindrical shape in which the diameter gradually contracts from one end to the center in an axial direction and then gradually expands from the center to the other end). With this arrangement, a rotational force about a y-axis (or an axis substantially in parallel thereto) and a translational force in a ±y direction (e.g. +y direction) are applied to a work W (e.g. a substantially cylindrical or substantially columnar work) led to be positioned between the regulating wheel 1 and the grinding wheel 2.

The first dressing device 112 is a device for dressing the regulating wheel 1 and is comprised of, for example, a rotary dresser.

The first rotating mechanism 211 is reciprocatably supported by a regulating wheel slider 11 in a horizontal direction (±x direction (and ±y direction, as necessary)) or along a surface at an angle with respect to a horizontal surface. The regulating wheel slider 11 is driven in the horizontal direction (or a direction at an angle with respect to the horizontal direction (both the horizontal direction and a vertical direction)) by the first drive mechanism 212 comprised of an actuator, such as an electric motor or a piston cylinder unit. The regulating wheel slider 11 is mounted on a bed through the intermediary of a base 10. The regulating wheel slider 11 turns about an axis (turning pin), which is parallel to a z-axis and is configured such that the angle formed by the axis $O_1$ of the regulating wheel 1 with respect to the y-axis can be adjusted. The regulating wheel slider 11 is mounted on the bed through the intermediary of the base 10 (or a lower slider). Alternatively, the regulating wheel slider 11 may be mounted directly on the bed.

The grinding wheel 2 has a substantially columnar shape, is disposed with its outer peripheral surface opposing the outer peripheral surface of the regulating wheel 1, and is supported by the second rotating mechanism 221, which is comprised of an actuator such as an electric motor, so that the grinding wheel 2 can rotate about the axis $O_2$ (an axis parallel to the y-axis). The second dressing device 122 is a device for dressing the grinding wheel 2 and is comprised of, for example, a rotary dresser. The second rotating mechanism 221 is supported by a grinding wheel slider 12 mounted on the bed such that the second rotating mechanism 221 can reciprocate in, for example, the horizontal direction (±x direction (and ±y direction, as necessary)) or along a surface at an angle with respect to a horizontal surface. The grinding wheel slider 12 is driven in the horizontal direction (or a direction at an angle with respect to the horizontal direction (both the horizontal direction and the vertical direction) by the second drive mechanism 222 comprised of an actuator, such as an electric motor or a piston cylinder unit.

The blade 4 is disposed between the regulating wheel 1 and the grinding wheel 2. The blade 4 is fixed to a work rest 6 mounted on the bed. The work rest 6 is driven in the vertical direction (±z direction) (or a direction at an angle with respect to the vertical direction (both the vertical direction and the horizontal direction)) by the third drive mechanism 232 comprised of an actuator, such as an electric motor or a piston cylinder unit. The third drive mechanism 232 may be omitted.

The work rest 6 is provided with a first stress sensor $S_1$ and a second stress sensor $S_2$, which output signals based on an external force acting on the blade 4 (or the amount of strain of the work rest 6). The first stress sensor $S_1$ and the second stress sensor $S_2$ are composed of, for example, strain gauges having the same specifications. At least one of the first stress sensor $S_1$ and the second stress sensor $S_2$ may be provided on the blade 4.

Figure 2:
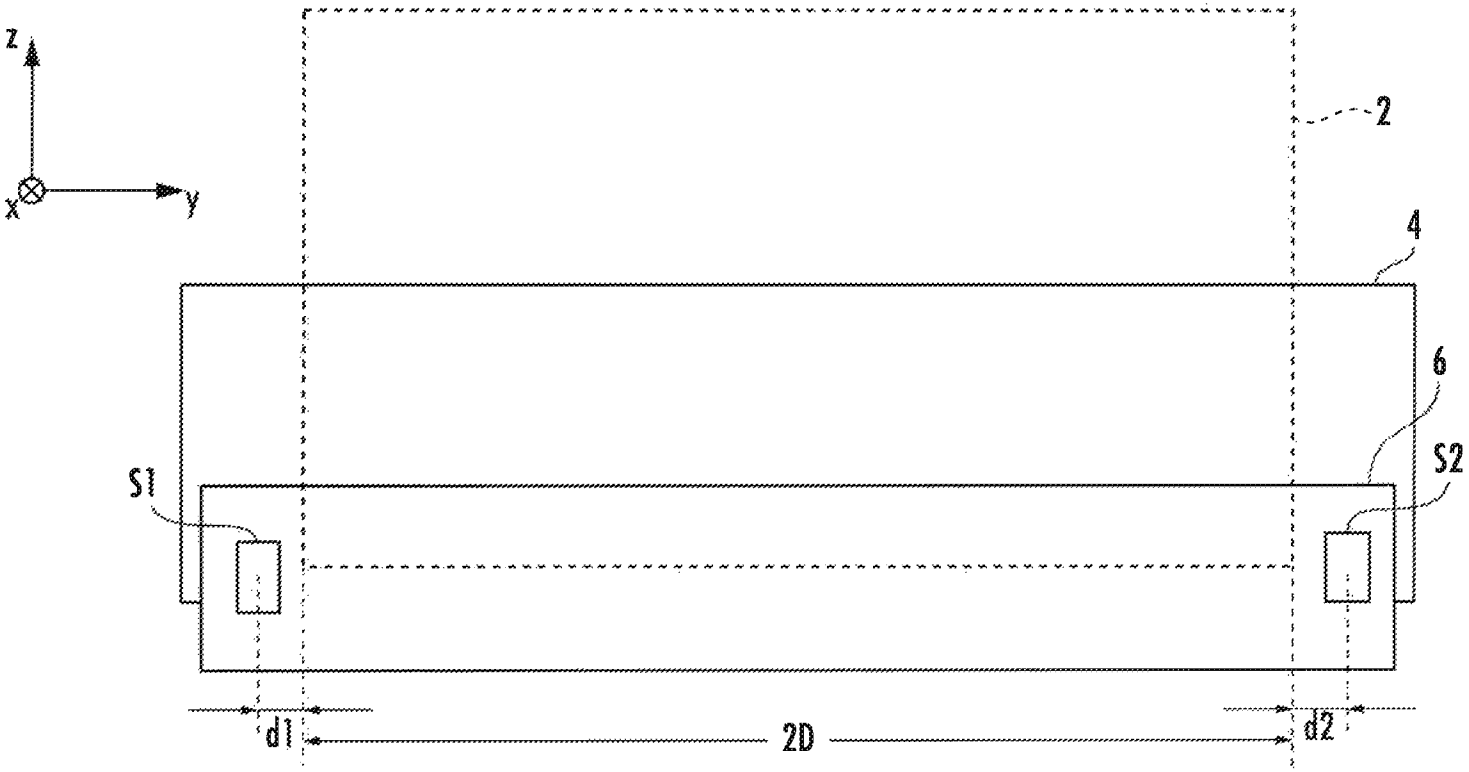
FIG. 2 is an explanatory diagram related to the placement of stress sensors in the centerless grinding apparatus.

As illustrated in FIG. 2, the first stress sensor $S_1$ is disposed at a position denoted by $(x, y, z)=(x_0, -D-d_1, z_0)$, which deviates in the −y direction from a target area $(y\|-D\leq y\leq D)$ overlapping with the areas, in which the regulating wheel 1 and the grinding wheel 2 extend, in the area in which the blade 4 extends with respect to the y-direction. The second stress sensor $S_2$ is disposed at a position denoted by $(x, y, z)=(x_0, D+d_2, z_0)$, which deviates in the +y direction from the target area. The positions of the first stress sensor $S_1$ and the second stress sensor $S_2$ in the x-direction and the z-direction (or the vertical direction) may be different.

The controller 20 is comprised of a computer (including a CPU (arithmetic processing unit), a memory (storage device), such as a ROM or RAM, an input/output I/F circuit, and the like). The controller 20 controls the operation of each of the first rotating mechanism 211, the first drive mechanism 212, the second rotating mechanism 221, the second drive mechanism 222, the third drive mechanism 232, the first dressing device 112, and the second dressing device 122.

The controller 20 comprised of a computer is designed or programed such that an arithmetic processing unit (a CPU, a single-core processor or a multi-core processor) constituting the computer reads required software and data from a storage device (a ROM, RAM or the like) constituting the computer, and carries out arithmetic processing on the data according to the software.

The controller 20 includes a storage device 21, a load measurement unit 22, a frequency analyzer 23, and a designation processing unit 24. The storage device 21 stores and holds, for example, the correlation information indicating the correlation between the loads acting on the blade 4 and the outputs of the first stress sensor $S_1$ and the second stress sensor $S_2$. The load measurement unit 22 measures a load acting on the blade 4 on the basis of the outputs of the first stress sensor $S_1$ and the second stress sensor $S_2$ and according to the correlation information stored in the storage device 21. The frequency analyzer 23 determines whether a component of a designated frequency extracted by performing a frequency analysis of the time series of the load measured by the load measurement unit 22 exceeds a threshold value. The designation processing unit 24 carries out designation processing for setting the component of the designated frequency to the threshold value or less in the case where the frequency analyzer 23 determines that the component of the designated frequency exceeds the threshold value.

(Functions)

(Basic Function)

In an infeed centerless grinding apparatus, the three contacts among the work W, the regulating wheel 1, the grinding wheel 2, and the blade 4 are properly positioned when the work W is supplied between the regulating wheel 1 and the grinding wheel 2, and desired grinding is accomplished by infeeding the regulating wheel 1 or the grinding wheel 2 in the radial direction of the work W. The interval between the regulating wheel 1 and the grinding wheel 2 is adjusted in advance by controlling the position of at least one of the first drive mechanism 212 and the second drive mechanism 222. As illustrated in FIG. 1, a segment L that connects the center of the regulating wheel 1 (the axis $O_1$) and the center of the grinding wheel 2 (the axis $O_2$) on an x-z plane is parallel to the x-axis, and the center of the work W, $O_w$, is positioned above the segment L.

The operations of the first rotating mechanism 211 and the second rotating mechanism 221 are controlled such that the regulating wheel 1 rotates clockwise about the axis $O_1$ and the grinding wheel 2 rotates clockwise about the axis $O_2$. In this process, the work W is subjected to grinding or infeed grinding from the outer periphery thereof by the grinding wheel 2 while the work W is rotating counterclockwise about the axis $O_w$. As the machining is repeated, if, for example, the intensity of a rotational frequency component of the grinding wheel in the grinding process gradually increases, then it is determined that the grinding wheel has developed a local wear, and the grinding wheel is dressed. Further, during the grinding process, if a frequency that is twelve times a work rotational frequency is detected, then it is determined that the outer periphery of the work has developed an undulating shape of a twelve-crest component, and the center height is decreased before resuming the grinding. In particular, if a work has a large strain, the proper center height thereof changes according to the shape of the material thereof. Thus, automatically adjusting the center height while monitoring the frequency of a dynamic load change during a machining process makes it possible to stably secure a higher shape accuracy.

In the case of a through-feed centerless grinding apparatus, as described above, a change in the grinding resistance while the outer surface of the work W is being ground can be measured in the process during which the work W moves in a translational manner from one end sides to the other end sides of the regulating wheel 1 and the grinding wheel 2 in the axial direction of the work W. Determining a change in the grinding resistance to the work W, which is ground while moving between the wheels 1 and 2, makes it possible to know a change in the clearance between the two wheels 1 and 2, i.e. a change in the grinding amount, thus enabling the control of the wear states of the wheels 1 and 2.

(Characteristic Functions)

Figure 3:
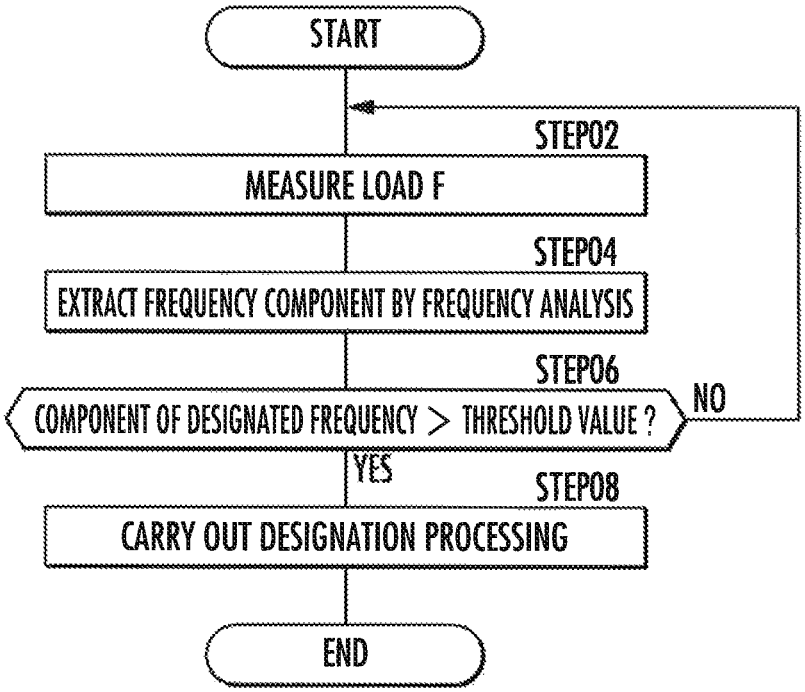
FIG. 3 is an explanatory diagram related to characteristic functions of the centerless grinding apparatus.

Based on the outputs of the first stress sensor $S_1$ and the second stress sensor $S_2$ and according to the correlation information stored in the storage device, the load F acting on the blade 4, i.e. the load acting on the work W supported by the blade 4 and the load operating position y in the blade 4 at any given time are measured by the load measurement unit 22 (STEP02 in FIG. 3).

The storage device 21 stores and holds the correlation information indicating the correlation among the load F acting on the blade 4, the operating position (y coordinate value) of the load F in the blade 4, and the output s of the first stress sensor $S_1$. The correlation is represented by, for example, an expression $s=g_1(F, y)$, which denotes a curved surface in a space denoted by F–y–s. The storage device 21 stores and holds the correlation among the load F acting on the blade 4, the operating position (y coordinate value) of the load F in the blade 4, and the output s of the second stress sensor $S_2$. The correlation is represented by, for example, an expression $s=g_2(F, y)$, which denotes a curved surface in the space denoted by F–y–s.

The specifications of the first stress sensor $S_1$ and the second stress sensor $S_2$ are the same. In the y-direction, the first stress sensor $S_1$ is disposed in a negative area and the second stress sensor $S_2$ is disposed in a positive area (refer to FIG. 2). Hence, there is a relationship represented by relational expression (01) between the functions $g_1(F, y)$ and $g_2(F, y)$, which have y and F as variables.

$$g_1(F_0,y-(d_2-d_1)/2=g_2(F_0,-y+(d_2-d_1)/2 \quad (01)$$

Relational expression (01) indicates that curve $s=g_1(F, y_0)$ and curve $s=g_2(F, y_0)$ have reflectionally symmetrical change characteristics with respect to a straight line $y=(d_2-d_1)/2$ on a plane denoted by $F=F_0$, which is parallel to a plane denoted by s–y. If $d_1=d_2$, then relational expression (01) is denoted by a simpler form as relational expression (01').

$$g_1(F_0,y)=g_2(F_0,-y) \quad (01')$$

Figure 4:
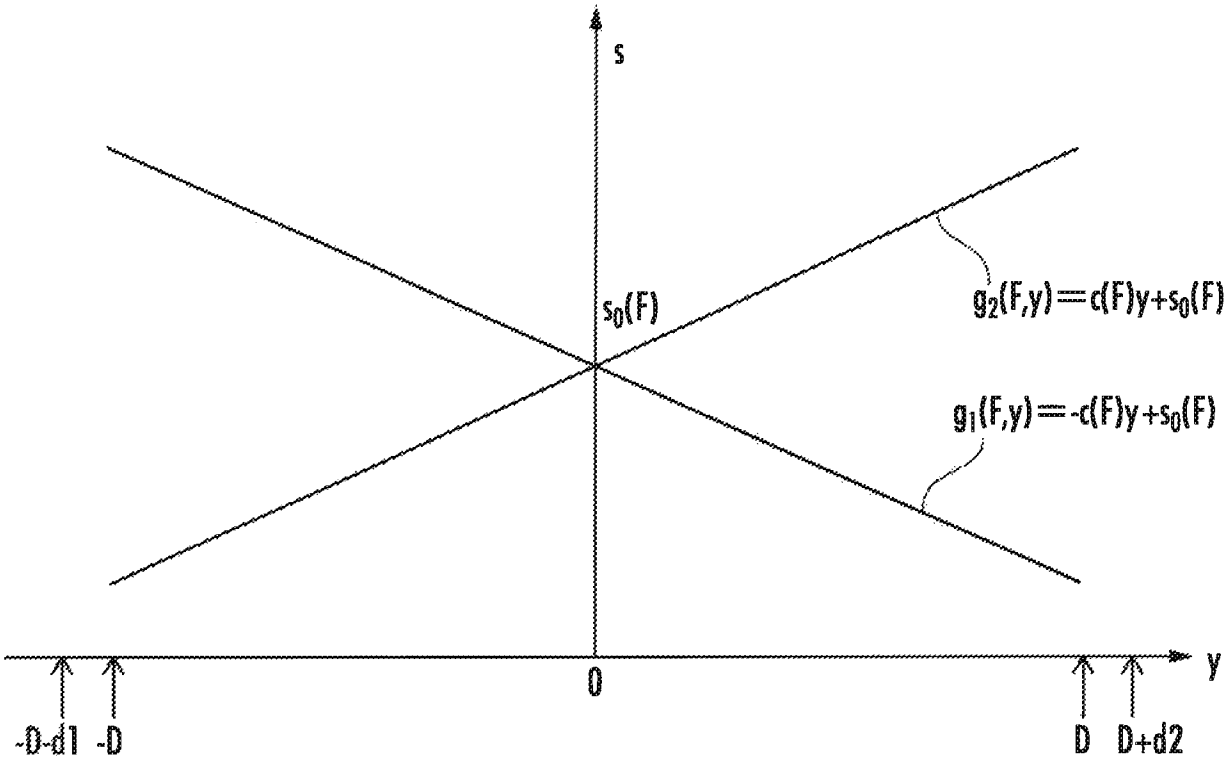
FIG. 4 is an explanatory diagram related to the output modes of a pair of stress sensors on the basis of load operating positions.

FIG. 4 illustrates an example of the change modes of the output s of the first stress sensor $S_1$ and the output s of the second stress sensor $S_2$ according to the operating position y of any load F in the blade 4 in the case where $d_1=d_2$. The output s of the first stress sensor $S_1$ is denoted by a linear function $g_1(F, y)=-c(F)y+s_0(F)$. The output s of the second stress sensor $S_2$ is denoted by a linear function $g_2(F, y)=c(F)y+s_0(F)$. "c (F) (>0)" denotes an inclination that changes according to the magnitude of the load F, and "$s_0$ (F) (>0) is an intercept that changes according to the magnitude of the load F.

The function $g_1(F, y)$ and the function $g_2(F, y)$ have natures represented by relational expressions (02) and (03).

$$(\partial g_1/\partial y)<0,(\partial g_2/\partial y)>0 \quad (02)$$

Relational expression (02) indicates that the function $g_1(F, y)$ is a decreasing function with respect to the variable y, while the function $g_2(F, y)$ is an increasing function with respect to the variable y. In the embodiment illustrated in FIG. 3, the inclination –c (F) of the linear function $g_1(F, y)$ takes a negative value, whereas the inclination c (F) of the linear function $g_2(F, y)$ takes a positive value.

$$(\partial g_1/\partial F)>0,(\partial g_2/\partial F)>0 \quad (03)$$

Relational expression (03) indicates that the function $g_1(F, y)$ and the function $g_2(F, y)$ are increasing functions with respect to the variable F. Therefore, by using a value obtained by adding the function $g_1$ and the function $g_2$, a load measurement sensitivity will remain constant regardless of the place of a work on a blade, thus enabling accurate and stable detection of a load change due to, for example, a local wear on a grinding wheel of a centerless grinding apparatus typically using a large, wide grinding wheel.

Figure 5:
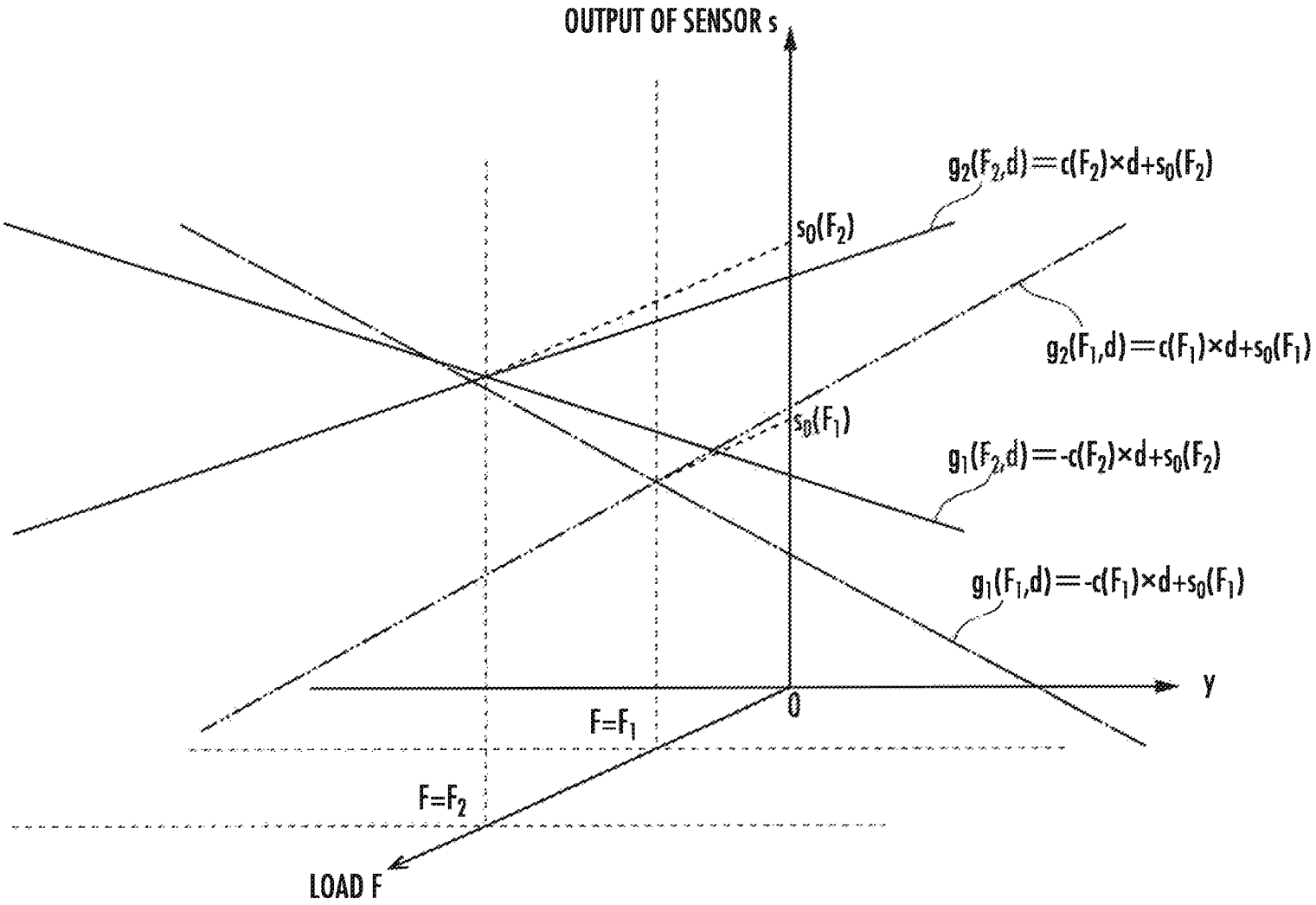
FIG. 5 is an explanatory diagram related to the output modes of the pair of stress sensors on the basis of loads and the operating positions of the loads.

FIG. 5 illustrates an example of the change modes of the output of the first stress sensor $S_1$ and the output of the second stress sensor $S_2$ according to the load F in addition to the load operating position y in the blade 4. The change modes of functions $s=g_1(F=F_1, y)$ and $s=g_2(F=F_1, y)$ in the case where the load F acting on the blade 4 is denoted by $F_1$ are indicated by the chain line. This corresponds to the line of intersection of each of the curved surface $s=g_1(F, y)$ and the curved surface $s=g_2(F, y)$ and a plane $F=F_1$. The change modes of the function $s=g_1(F=F_2, y)$ and the function $s=g_2(F=F_2, y)$ in the case where the load F acting on the blade 4 is $F_2$ ($>F_1$) are indicated by the solid lines. It is seen that the intercept $s_0$ (F) and the output s of the first stress sensor $S_1$ and the output s of the second stress sensor $S_2$ tend to increase as the load F increases.

If the output s of the first stress sensor $S_1$ at any given time is denoted by $s_1$ and the output s of the second stress sensor $S_2$ at any given time is denoted by $s_2$, then the coordinate values (F, y) of the intersection point of a curve $s_1=g_1(F, y)$ and $s_2=g_2(F, y)$ in an F-y plane are measured as the load F acting on the blade 4 and the operating position y at that time. A time series F (t) of the measured load F is stored in the storage device 21. The measurement cycle of the load F (t) may be identical to the clock frequency of a CPU constituting the controller 20 and may be any given period, such as 1 [s] or 10 [s].

The placement (and specifications) of the first stress sensor $S_1$ and the second stress sensor $S_2$ may be adjusted such that the functions $g_1(f, y)$ and $g_2(f, y)$ have an approximate relationship represented by a relational expression (04) in addition to the foregoing relational expression (01).

$$g_1(f,y)+g_2(f,y)=f \quad (04)$$

In this case, the load F acting on the blade 4 is immediately measured from the outputs of the first stress sensor $S_1$ and the second stress sensor $S_2$.

Subsequently, the frequency analyzer 23 carries out a frequency analysis on the time series F (t) of the load F thereby to extract the component of each of a plurality of frequencies (discrete values) (STEP04 of FIG. 3). More specifically, the load F (t) as a time function is subjected to Fourier series expansion so as to calculate or extract each Fourier coefficient as the component of a corresponding frequency. Thus, components having discrete frequencies $f_1$, $f_2$, . . . $f_n$ as the centers thereof are extracted, as illustrated in, for example, FIG. 6.

Further, the frequency analyzer 23 determines whether the component of a designated frequency exceeds a threshold value (STEP06 of FIG. 3). For example, a frequency obtained by multiplying a rotational frequency $q_w$ of the work W by a predetermined integral multiple $m\times q_w$ (m=3, 12, 16 or the like) is set as the designated frequency. In the case of m=16, it means that the outer surface in the cross section of the work W has a shape having sixteen undulations per round (the amplitude being a few μm). The rotational frequency $q_w$ of the work W is expressed by $q_w=(r_2/r_w)q_1$ on the basis of, for example, a radius $r_w$ of the work W and a radius $r_1$ and the rotational frequency $q_1$ of the regulating wheel 1.

Figure 6:
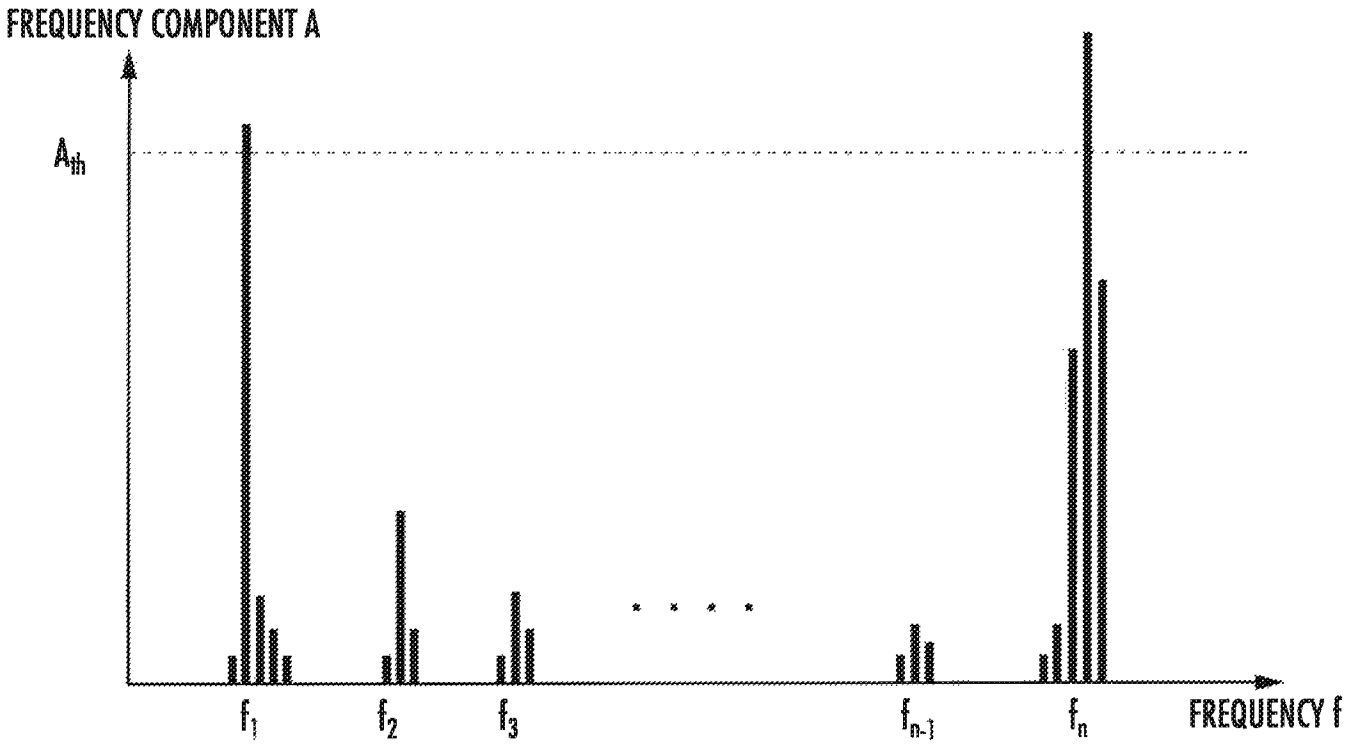
FIG. 6 is an explanatory diagram related to the extraction results of frequency components.

If the determination result is negative (NO in STEP06 of FIG. 3), then the processing after the measurement of the load F (STEP02 of FIG. 3) is repeated. Meanwhile, if the determination result is affirmative (YES in STEP06 of FIG. 3), then designation processing is carried out by the designation processing unit 24 (STEP08 of FIG. 3). Referring to FIG. 6, if, for example, $f=f_n$ is a designated frequency, then the component of $f=f_n$ exceeds a threshold value $A_{th}$, so that the determination result will be affirmative. The threshold value $A_{th}$ may be the same value or different values for a plurality of designated frequencies.

The designation processing is the processing for setting the component of a designated frequency to a threshold value or less. More specifically, the designation processing may include at least one of an operation for causing the first drive mechanism 212 to drive the regulating wheel 1 in the horizontal direction, an operation for causing the second drive mechanism 222 to drive the grinding wheel 2 in the horizontal direction, and an operation for causing the third drive mechanism 232 to drive the work rest 6 in the vertical direction, in order to adjust the center height of the work W (the height of a point $O_w$ when a segment $O_1$-$O_2$ is the reference). A fine adjustment of the center height in the vertical direction brings the outer surface in the cross section of the work W closer to an exact round shape, so that the component of the designated frequency decreases to the threshold value or less.

In the case where a plurality of designated frequencies are classified into first designated frequencies and second designated frequencies, the designation processing may include control processing for driving the regulating wheel 1 by the first drive mechanism 212 and for driving the grinding wheel 2 by the second drive mechanism 222 thereby to decrease the center height of the work W if the components of the first designated frequencies exceed a first threshold value, or to increase the center height of the work W if the components of the second designated frequencies exceed the threshold value.

In addition, the designation processing may include control processing for actuating the first dressing device 112 and the second dressing device 122 so as to dress the regulating wheel 1 by the first dressing device 112 and to dress the grinding wheel 2 by the second dressing device 122 in addition to or in place of dressing the regulating wheel 1 by the first dressing device 112. When the sharpness of the grinding wheel 2 is restored or improved by dressing, the outer surface in the cross section of the work W approaches to the exact round shape, so that the component of a designated frequency decreases to a threshold value or less.

What is claimed is:

1. A centerless grinding apparatus comprising:

a grinding wheel;

a regulating wheel;

a blade disposed between the grinding wheel and the regulating wheel;

a work rest which supports the blade;

a stress sensor disposed on the work rest;

a first drive mechanism which drives the regulating wheel in at least a horizontal direction;

a second drive mechanism which drives the grinding wheel in at least the horizontal direction; and a controller which controls operation of each of the first drive mechanism and the second drive mechanism, wherein a work is supported by the grinding wheel, the regulating wheel and the blade, and the grinding wheel and the regulating wheel are rotated thereby to grind the work, a pair of stress sensors acting as the stress sensor are each disposed at different places in the blade or the work rest in a longitudinal direction of the blade, and the controller includes:

a storage device which stores a correlation information indicating a correlation between loads acting on the blade and each of outputs of the pair of stress sensors;

a load measurement unit which measures a load applied to the blade based on each of the outputs of the pair of stress sensors and according to the correlation information stored in the storage device;

a frequency analyzer which determines whether a component of a designated frequency extracted by performing a frequency analysis of a time series of the load measured by the load measurement unit exceeds a threshold value; and a designation processing unit which carries out designation processing for setting the component of the designated frequency to the threshold value or less in a case where the frequency analyzer determines that the component of the designated frequency exceeds the threshold value.

2. The centerless grinding apparatus according to claim 1, wherein the designation processing unit at least either causes the first drive mechanism to drive the regulating wheel at least in the horizontal direction or causes the second drive mechanism to drive the grinding wheel at least in the horizontal direction as the designation processing in order to adjust a center height of the work.

3. The centerless grinding apparatus according to claim 1, further comprising:

a third drive mechanism which drives the work rest in at least a vertical direction, wherein the controller is configured to control an operation of the third drive mechanism in addition to the operations of the first drive mechanism and the second drive mechanism, and the designation processing unit causes the third drive mechanism to drive the work rest at least in the vertical direction as the designation processing in order to adjust a center height of the work.

4. The centerless grinding apparatus according to claim 2, wherein the designation processing unit carries out the designation processing so as to decrease the center height of the work in a case where a component of a first designated frequency as the designated frequency exceeds a first threshold value as the threshold value, or to increase the center height of the work in a case where a component of a second designated frequency as the designated frequency exceeds a second threshold value as the threshold value.

5. The centerless grinding apparatus according to claim 1, further comprising:

a dressing device for dressing at least one of the regulating wheel and the grinding wheel, and the designation processing unit performs dressing on at least one of the regulating wheel and the grinding wheel by the dressing device as the designation processing.

6. The centerless grinding apparatus according to claim 1, wherein the storage device stores the information indicating a correlation among a load acting on the blade, a load operating position in the blade, and the outputs of each of the pair of stress sensors as the correlation information, and the controller measures the load acting on the blade and the load operating position in the blade based on the outputs of each of the pair of stress sensors and according to the correlation information stored in the storage device.

7. The centerless grinding apparatus according to claim 6, wherein the storage device stores, as the correlation information, expressions $s=g_1(f, y)$ and $s=g_2(f, y)$, which denote a curved surface in a three-dimensional Cartesian coordinate system having a load F acting on the blade, a load operating position y in the blade, and an output s of each of the pair of stress sensors as the coordinate axes thereof, and the controller measures the load F acting on the blade and the load operating position y in the blade as a coordinate value of an intersection point of curves $s_1=g_1(f, y)$ and $s_2=g_2(f, y)$ in a plane f-y based on outputs $s_1$ and $s_2$ of each of the pair of stress sensors and according to the correlation information.

8. The centerless grinding apparatus according to claim 1, wherein the pair of stress sensors are disposed symmetrically with reference to the blade.

9. A work grinding condition monitoring method for monitoring a grinding condition of a work in centerless grinding apparatus that includes: a grinding wheel; a regulating wheel; a blade disposed between the grinding wheel and the regulating wheel; a work rest which supports the blade; a stress sensor disposed on the work rest; a first drive mechanism which drives the regulating wheel in at least a horizontal direction; a second drive mechanism which drives the grinding wheel in at least the horizontal direction; and a controller which controls operations of each of the first drive mechanism and the second drive mechanism, wherein a work is supported by the grinding wheel, the regulating wheel and the blade, and the grinding wheel and the regulating wheel are rotated thereby to grind the work, a pair of stress sensors acting as the stress sensor each being disposed at different places in the blade or the work rest in a longitudinal direction of the blade, the work grinding condition monitoring method comprising:

a load measurement step of measuring a load acting on the blade based on outputs of each of the pair of stress sensors and according to correlation information indicating a correlation between the load acting on the blade and the outputs of each of the pair of stress sensors;

a frequency analysis step of determining whether a component of a designated frequency, which is extracted by performing a frequency analysis of a time series of the load measured by the load measurement step, exceeds a threshold value; and a designation processing step of carrying out designation processing for setting the component of the designated frequency to the threshold value or less in a case where it is determined in the frequency analysis step that the component of the designated frequency exceeds the threshold value.

* * * * *